US009869317B2

(12) United States Patent
Schofield

(10) Patent No.: US 9,869,317 B2
(45) Date of Patent: Jan. 16, 2018

(54) PUMP

(71) Applicant: Edwards Limited, Crawley, West Sussex (GB)

(72) Inventor: Nigel Schofield, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 1355 days.

(21) Appl. No.: 13/762,070

(22) Filed: Feb. 7, 2013

(65) Prior Publication Data

US 2013/0209222 A1 Aug. 15, 2013

(30) Foreign Application Priority Data

Feb. 8, 2012 (GB) ..... 1202193

(51) Int. Cl.

| | |
|---|---|
| ***F03D 7/00*** | (2006.01) |
| ***F04D 13/12*** | (2006.01) |
| ***F04C 23/00*** | (2006.01) |
| ***F04C 25/02*** | (2006.01) |
| ***F04C 28/06*** | (2006.01) |

(52) U.S. Cl.

CPC ..... *F04D 13/12* (2013.01); *F04C 23/001* (2013.01); *F04C 25/02* (2013.01); *F04C 28/06* (2013.01)

(58) Field of Classification Search

CPC ..... F04D 13/12; F04D 25/16; F04C 23/01; F04C 28/06

USPC ..... 415/58.5, 58.7, 199.4, 199.5, 198.1, 26, 415/27, 28, 49, 50, 144, 145

See application file for complete search history.

(56) References Cited

U.S. PATENT DOCUMENTS

| | | | | |
|---|---|---|---|---|
| 2,386,765 | A * | 10/1945 | Adams | F02M 1/00 123/574 |
| 4,995,794 | A | 2/1991 | Wycliffe | |
| 6,030,181 | A * | 2/2000 | Conrad | F04B 37/14 417/251 |
| 8,500,422 | B2 * | 8/2013 | Dowdeswell | F01C 21/104 418/149 |
| 2002/0134439 | A1 * | 9/2002 | Kawasaki | C23C 16/4412 137/565.23 |
| 2007/0274822 | A1 * | 11/2007 | Liu | F04D 17/122 415/90 |
| 2008/0193303 | A1 * | 8/2008 | Stones | F04D 19/042 417/251 |

(Continued)

FOREIGN PATENT DOCUMENTS

| | | |
|---|---|---|
| EP | 1398509 A2 | 3/2004 |
| JP | 2010138741 | 6/2010 |

(Continued)

OTHER PUBLICATIONS

Search Report from counterpart European application No. EP 13154470.2, dated Feb. 21, 2014, 5 pp.

*Primary Examiner* — Dwayne J White
*Assistant Examiner* — Jason Mikus
(74) *Attorney, Agent, or Firm* — Shumaker & Sieffert, P.A.

(57) ABSTRACT

The present invention relates to a multi-stage vacuum pump having a plurality of compression stages 12, 14, 16, 18 20 and a booster stage 22. The pump 10 is arranged to pump a chamber 24. The pumping stages include respective rotors supported for rotation on one or more common drive shafts 26. A recirculation valve 28 is associated with the booster stage 22 for selective recirculation of pumped fluid from an outlet 32 to an inlet 30 of the booster stage above a predetermined pressure.

18 Claims, 5 Drawing Sheets

(56) References Cited

U.S. PATENT DOCUMENTS

| | | | | |
|---|---|---|---|---|
| 2009/0178655 | A1* | 7/2009 | Boley | F02B 37/16 123/564 |
| 2011/0318210 | A1* | 12/2011 | Schofield | F04C 18/084 418/10 |

FOREIGN PATENT DOCUMENTS

| | | | |
|---|---|---|---|
| WO | 2005061896 | A2 | 7/2005 |
| WO | 2006048602 | A2 | 5/2006 |
| WO | WO2011/039812 | | 4/2011 |

* cited by examiner

PUMP

BACKGROUND OF THE INVENTION

The invention relates to a multi-stage vacuum pump and a stator of such a pump.

Vacuum pumps are used for example in the manufacture of semiconductors or flat panel displays. During manufacture a processing gas is released into a chamber. It is often desirable to maintain a low pressure in the chamber whilst at the same time providing a relatively high flow of gas through the chamber. A typical pumping arrangement for achieving both low pressure and relatively high through put is to combine a booster pump with a backing pump. The backing pump may be a multi-stage pump principally provided to produce a high compression ratio for generating a low pressure in the chamber. The booster pump is usually a single stage pump with a high capacity for producing relatively high gas flow. The booster pump generates only a small amount of compression.

BRIEF SUMMARY OF THE INVENTION

The present invention provides a multi-stage vacuum pump having a plurality of compression stages and a booster stage, the compression and booster stages comprising respective rotors supported for rotation on one or more common drive shafts, wherein a ratio of volumetric capacity between the booster stage and the adjacent downstream compression stage is more than 5:1, and wherein the pump comprises a recirculation valve associated with the booster stage for selective recirculation of pumped fluid from an inlet to an outlet of the booster stage above a predetermined pressure.

The ratio of the volumetric capacity of the booster stage to the adjacent downstream compression stage means that the booster stage provides greater resistance to rotation at higher pressures. The compression stages may have a ratio of volumetric capacity between adjacent compression stages of less than 2:1, which is significantly less that ratio of the volumetric capacity of the booster stage to the adjacent downstream compression stage.

In the present invention, a multi-stage vacuum pump has a plurality of compression stages and a booster stage upstream of the compression stages, the compression and booster stages comprising respective rotors supported for rotation on one or more drive shafts common to the compression stages and the booster stage, the pump comprising a recirculation path extending from the booster outlet to the booster inlet for recirculating pumped gas only though the booster stage, a recirculation valve being located along the recirculation path for selective recirculation of pumped fluid from an inlet to an outlet of the booster stage above a predetermined pressure for reducing the power required to drive the booster stage above the predetermined pressure. The predetermined pressure may be selected such that recirculation is performed only during initial pump down of a vacuum enclosure from atmosphere when the energy required to rotate the comparatively high volumetric capacity booster stage is unduly high.

The present invention also provides a stator for such a multi-stage pump.

BRIEF DESCRIPTION OF THE SEVERAL VIEWS OF THE DRAWINGS

In order that the invention may be well understood, some embodiments thereof, which are given by way of example only, will now be described with reference to the drawings in which.

DETAILED DESCRIPTION OF THE INVENTION

Figure 1:
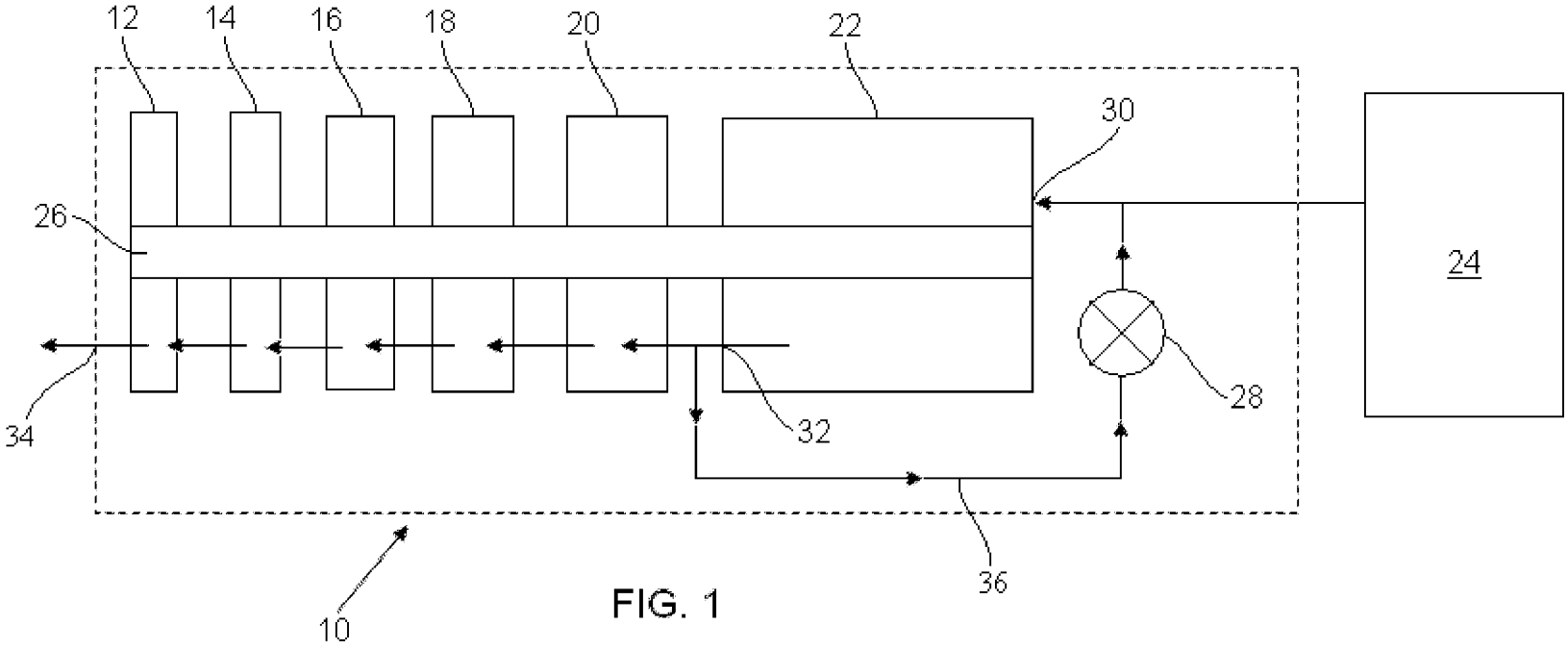
FIG. 1 shows schematically a multi-stage vacuum pump.

FIG. 1 is a highly schematic representation of a vacuum pump 10 (indicated by broken lines). The pump is multi-stage having a plurality of compression stages 12, 14, 16, 18 20 and a booster stage 22. The pump 10 is arranged to pump a chamber 24. The pumping stages comprise respective rotors supported for rotation on one or more common drive shafts 26. A recirculation valve 28 is associated with the booster stage 22 for selective recirculation of pumped fluid from an outlet 32 to an inlet 30 of the booster stage above a predetermined pressure. The predetermined pressure may be an absolute pressure for example 10 mbar taken at some point associated with the booster stage (e.g. the booster inlet 30) or a pressure difference between the booster outlet 32 and inlet 30, for example 10 to 100 mbar.

The example shown in FIG. 1 selects recirculation dependent on pressure difference. In this regard, the recirculation valve 28 has a first condition above a predetermined pressure difference in which fluid is recirculated and a second condition below the predetermined pressure difference in which fluid recirculation is resisted by the valve and relatively little or no fluid is recirculated.

In pump 10, the series of compression stages gradually reduce in volumetric capacity towards the exhaust 34 with the most upstream compression stage 20 having the highest capacity and the most downstream stage 12 having the lowest capacity. The pump 10 is generally designed to exhaust at atmosphere and therefore the size of the stages reduce as the pressure approaches atmosphere since the higher the pressure the more fluid in the stages resists rotation of the rotors. Accordingly, at pressures close to atmosphere in stage 12 the volumetric capacity is small compared to the capacity of the upstream stages. At lower pressures, the volumetric capacity of the stages increase as there is less fluid resistance and a larger capacity is required to work usefully on the fluid. Typically, a compression stage may have a volume capacity in a ratio of between about 2:1 and 1:1 with an adjacent downstream compression stage. It will be seen though that the volumetric capacity of the booster stage 22 is large compared to that of the compression stages. For example, the volumetric capacity of the booster stage may have a ratio of 5:1 or more with the most upstream compression stage 20. The volumetric capacity of the booster stage in some arrangements may be as much 10:1 or even 20:1 with the adjacent downstream pumping stage. By way of example, the booster stage may pump 1000 m3/hr whilst the successive compression stages may pump 100, 80, 60, 40, 25 m3/hr respectively.

The booster stage 22 is primarily provided for increasing pumping capacity at target vacuum pressures, for example at about 0.1 to 10 mbar. At these relatively low pressures, the booster stage must have a large volumetric capacity in order to pump sufficient fluid volume. However, when pump 10 has a relatively high inlet pressure or when the pump is pumping down chamber 24 from atmosphere, the large booster stage encounters significant fluid resistance. Although at low pressures the booster stage produces relatively little compression at these higher pressures close to atmosphere the booster stage develops greater compression. The provision of the recirculation path 36 reduces the resistance to rotation of the booster stage and allows the booster stage to be mounted on a common shaft with the compression stages. Without the recirculation path, a large torque would be required to rotate the drive shaft (including the booster stage) and the motor required to produce the necessary torque would be unduly expensive, particularly as the full capacity of the motor would only be required for a short period during evacuation at high pressures.

If for example the inlet pressure to the pump is 600 mbar and the booster outlet is at 800 mbar, the booster stage will encounter significant resistance to rotation. However, the recirculation path allows the pressure at the booster outlet 32 to equalise with, or at least approach, the pressure at the booster inlet 30. In this regard, the pressure difference between the inlet and the outlet causes fluid to flow from the booster outlet to the booster inlet along the recirculation path. As the pressure difference is reduced by this flow, the booster stage is required to generate less compression and therefore generates less resistance to rotation. With the recirculation valve open, in the above example, the inlet and outlet pressures may approach about 650 mbar.

When evacuating the chamber 24 from atmosphere the booster stage initially encounters significant resistance to rotation and therefore it is desirable that the recirculation valve is opened. As the pressure in chamber gradually reduces, the booster stage encounters less resistance until it is desirable to close the recirculation valve so that the booster stage can perform its primary purpose of pumping relatively large fluid flow at low pressure. The exact pressure at which the recirculation valve changes from an open condition to a closed condition depends on characteristics of the pump, such as the size of the booster stage and the compression stages and the type of pumping application. For example, a pressure difference of between about 10 mbar and 100 mbar may be selected as a switch-over pressure. The recirculation valve may be operated manually at the predetermined pressure or may be sensitive to the pressure difference such that above the predetermined pressure the valve is open and below the predetermined pressure the valve is closed. Alternatively, a separate pressure sensor may be provided which changes the condition of the recirculation valve dependent on pressure in the pump. FIGS. 2 and 3 show two different examples of pressure sensitive recirculation valves.

Figure 2A:
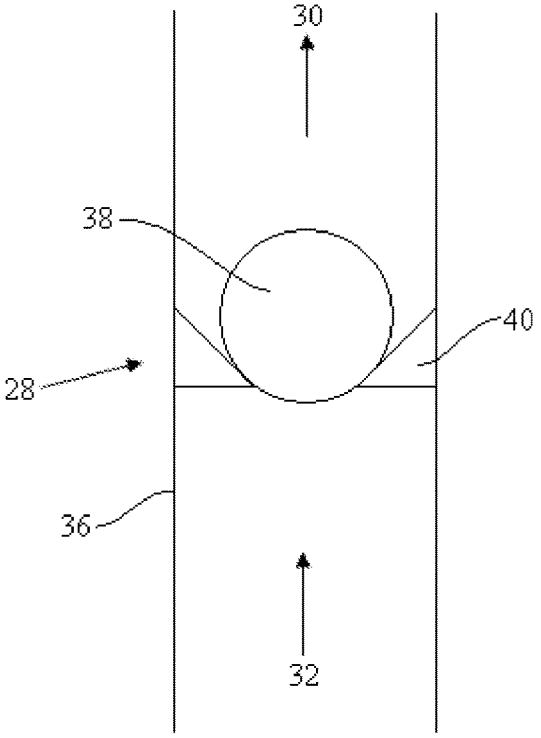
FIGS. 2A and 2B show a recirculation valve for the vacuum pump shown in FIG. 1, in a closed condition and an open condition.
Figure 2B:
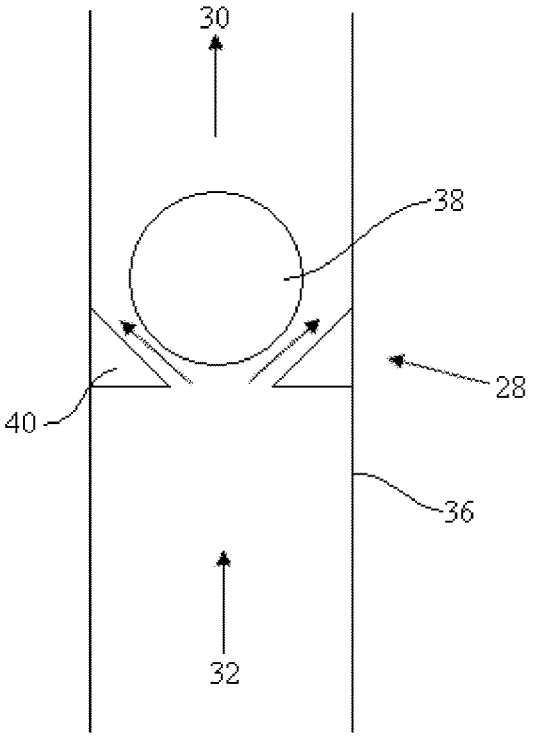

FIGS. 2A and 2B show a recirculation valve 28 which comprises a ball 38 of selected weight located in a valve seat 40. The valve 28 is positioned along recirculation path 36 and is shown in a closed condition in FIG. 2A and in an open condition in FIG. 2B. When the pressure difference between the booster inlet 30 and the booster outlet 32 is below the predetermined pressure, the force on the ball 38 due to fluid pressure is less than the gravitational force caused by the weight of the ball. Accordingly, the ball 38 remains located in the seat. When the pressure difference is above the predetermined pressure, the force on the ball 38 due to fluid pressure is greater than the gravitational force caused by the weight of the ball. Accordingly, the ball 38 is moved away from the seat allowing fluid to flow from the outlet to the inlet. The weight of the ball is selected such that the biasing force of the valve is balanced at the predetermined pressure.

Figure 3A:
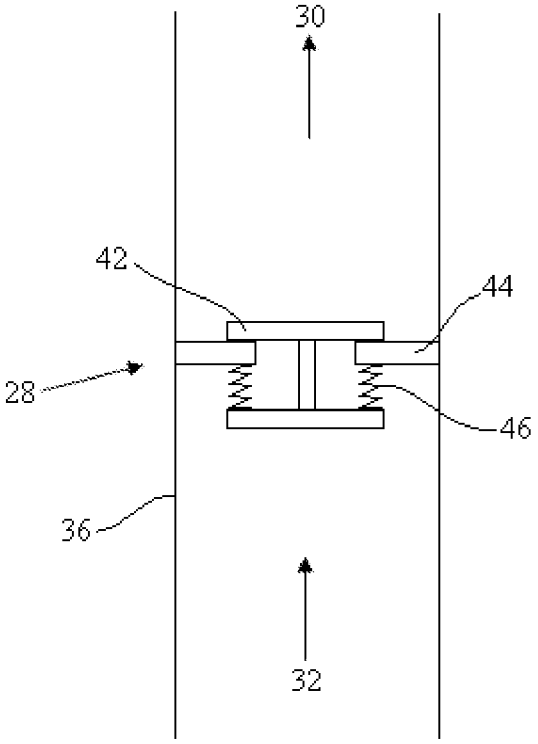
FIGS. 3A and 3B show another recirculation valve for the vacuum pump shown in FIG. 1, in a closed condition and an open condition.
Figure 3B:
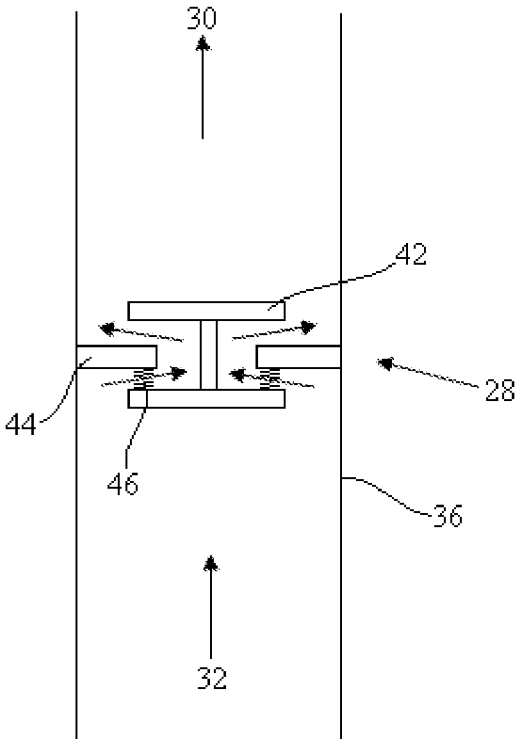

FIGS. 3A and 3B show an alternative valve arrangement in which a tappet valve 42 is biased into engagement with a valve seat 44 by a spring 46. The biasing force of the spring 46 is selected in a similar way to the weight of the ball 38 in the arrangement of FIGS. 2A and 2B. The valve 28 is positioned along recirculation path 36 and is shown in a closed condition in FIG. 3A and in an open condition in FIG. 3B. When the pressure difference is below the predetermined pressure, the force on the tappet 42 due to fluid pressure is less than the biasing force of the spring. Accordingly, the tappet 42 is engaged with the seat 44 resisting fluid flow from the outlet 32 to the inlet 30. When the pressure difference is above the predetermined pressure, the force on the tappet 42 due to fluid pressure is greater than the biasing force of the spring. Accordingly, the tappet 42 is moved away from the seat allowing fluid to flow from the outlet 32 to the inlet 30. The biasing force of the spring is selected such it is balanced with the fluid pressure at the predetermined pressure.

Referring again to FIG. 1, the pump shown schematically relates to any suitable pumping mechanism or pumping mechanisms in which the pumping stages are mounted on a common shaft. One suitable pumping mechanism is a roots or claw pumping mechanism. In a roots pumping mechanism the rotor assembly comprises two intermeshing sets of lobed Roots rotor components each set being mounted on a respective shaft. Each shaft is supported by bearings for rotation relative to the stator. The shafts are mounted within a stator so that each pumping chamber houses a pair of intermeshing rotor components, which together provide a stage of the pump. One of the shafts is driven by a motor connected to one end of that shaft. The other shaft is connected to that shaft by means of meshed timing gears so that the shafts are rotated synchronously but in opposite directions within the stator.

It will be seen therefore that the illustrated example selectively recirculates fluid from an outlet to an inlet of a booster stage of a multi-stage pump. Fluid is recirculated at higher pressures to reduce the energy required to rotate the high volumetric capacity booster stage. Recirculation stops at lower pressures when the energy required to rotate the booster stage is reduced and the booster stage is required to increase the volume of gas pumped. Earlier patents disclose recirculation of gas in a vacuum pump but not recirculation in a booster stage. For example, WO2011/039812 recirculates gas from an exhaust of a high pressure stage to an inlet of an intermediate stage of a multi-stage vacuum pump for reducing power consumption associated with the high pressure stages at low pump inlet pressures. In U.S. Pat. No. 6,030,181, recirculation in a turbomolecular stage is used to achieve rapid changes in pump inlet pressure. U.S. Pat. No. 4,995,794 discloses the use of recirculation of a purge gas in multiple pump stages for reducing the build of deposits in the pump. None of these earlier patents disclose the use of an upstream booster stage or recirculation of pumped gas in only the upstream stage at high pressures, as described in relation to present FIGS. 1 to 5.

Typically in multi-stage roots pumps, the pump housing comprises a gas inlet, a gas outlet and a plurality of pumping chambers, with adjacent pumping chambers being separated by a partition member, generally in the form of a transverse wall. Fluid transfer channels connect the pumping chambers together. The housing of such a multistage vacuum pump may be formed from two half-shell stator components, which define the plurality of pumping chambers and the fluid transfer channels for conveying gas between the pumping chambers. The transfer channels are located within the partition members serving to separate adjacent pumping chambers. In order to reduce the resistance to flow through the transfer channels, they must be relatively wide having a high conductance. This has the effect of increasing the thickness of the partition members and thus undesirably increasing the overall length of the pump.

Figure 4:
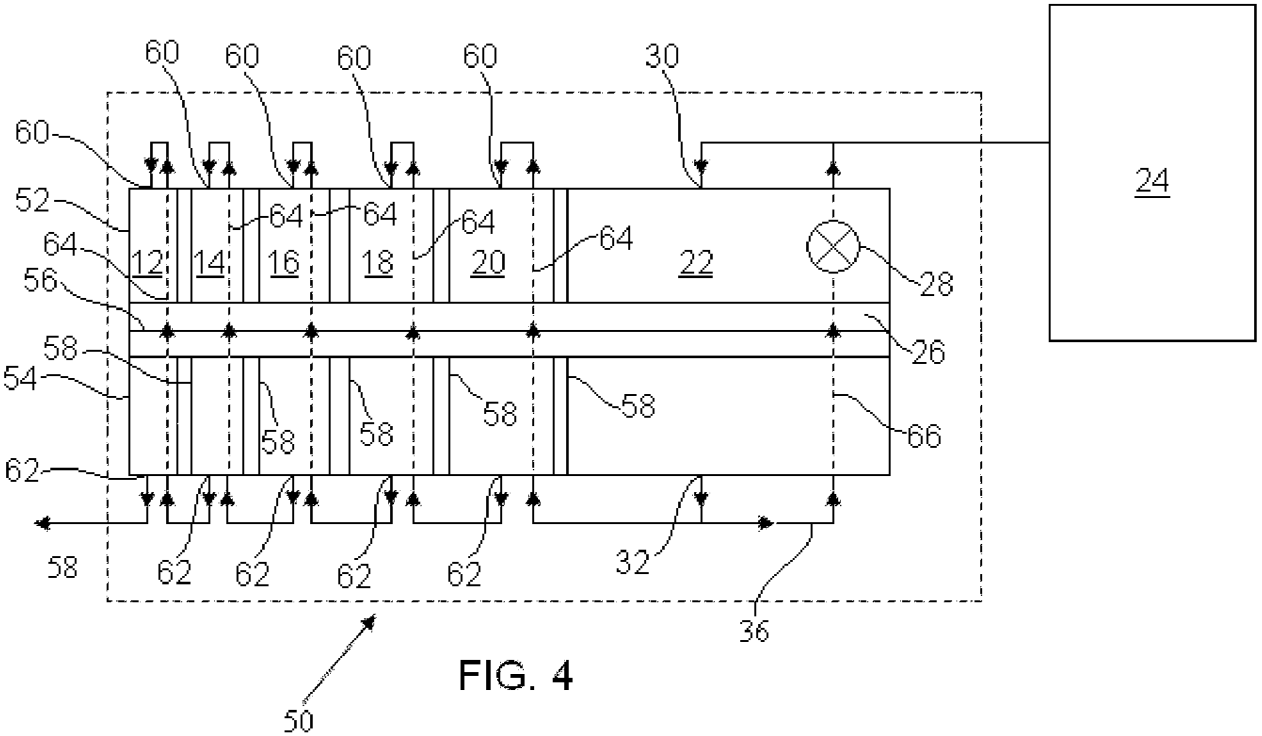
FIG. 4 shows schematically another multi-stage vacuum pump.

A modified pump 50 is shown schematically in FIG. 4 in which like references have been used for like features of the pump 10. A stator assembly of the pump 50 is shown in more detail in FIG. 5. The modified pump incorporates a similar arrangement to that disclosed in the present applicant's earlier patent publication WO2008/044064, the contents of which are hereby incorporated by reference.

Figure 5:
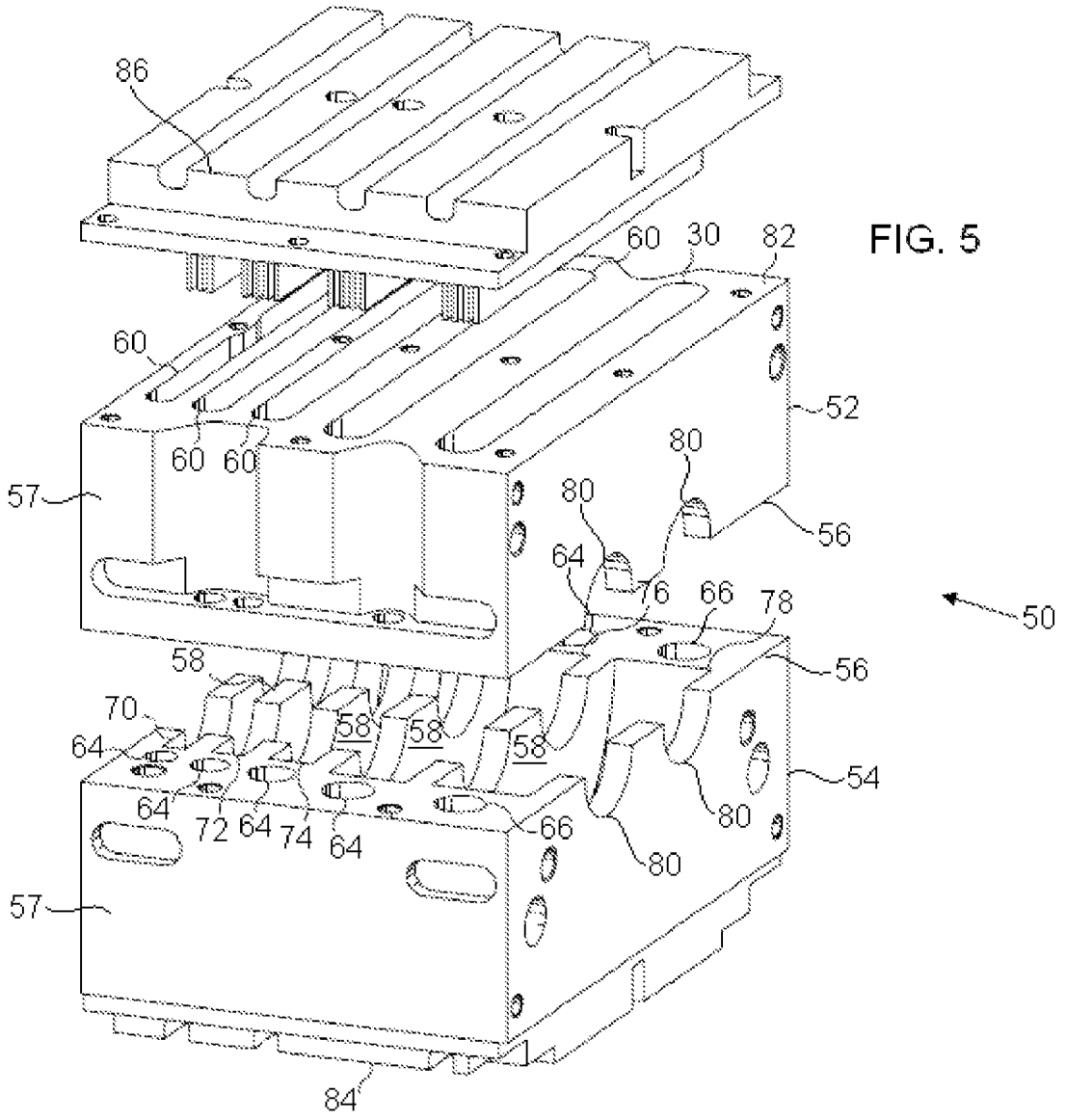
FIG. 5 shows in more detail a stator assembly suitable for the pump shown in FIG. 4.

Pump 50 comprises a stator assembly comprising a first stator component 52 and a second stator component 54 which are joined together along an intersection 56. The first and second stator components when joined together comprise an outer casing portion 57 which forms the pumping chambers of pumping stages 12, 14, 16, 18, 20, 22. Only five stages are shown in FIG. 5 comprising pumping chambers 70, 72, 74, 76, 78. Pumping chambers 70, 72, 74, 76 form part of the compression stages and chamber 78 forms part of the booster stage. Extending inwardly from the outer casing portion are inter-stage walls 58 which form the partitions between adjacent pumping chambers. The rotor assembly is not shown in FIG. 5 for simplicity and as its construction will be apparent to those skilled in the art. In the example shown in FIG. 5, each stage comprises two rotors received in respective pumping chambers. The drive shafts are received in generally circular holes 80 formed in the head plates and the inter-stage walls 58 when the stator shell components 52, 54 are assembled.

The inlet to the booster stage is port 30 and the outlet to the booster stage is port 32 (hidden in FIG. 5). Each further pumping stage 12, 14, 16, 18, 20 comprises a respective inlet port 60 for receiving fluid to be pumped by that pumping chamber. The inlet ports are open on the top external surface 82 of the first stator component 52. Each further pumping chamber 12, 14, 16, 18, 20 also comprises a respective outlet port 62 through which pumped fluid is exhausted from the chamber. The outlet ports are open on the bottom external surface 84 of the second stator component 54.

The stator components 52, 54 also define transfer channels 64 (shown in broken lines in FIG. 4) for conveying fluid between the pumping chambers. Each of the transfer channels is located in the outer casing portion of the stator assembly to the side of, preferably co-planar with, a respective pumping chamber, and is configured to receive fluid from the outlet port of the pumping chamber located immediately upstream from its respective pumping chamber, and to convey fluid to the inlet port of its respective pumping chamber. The transfer channel is not therefore required to pass through the inter-stage walls of the stator assembly allowing these walls to be relatively thin in an axial direction, which is an advantage in the present pump having both compression stages and booster stage in axial alignment.

Additionally, the stator components 52, 54 also define a recirculation channel 66 (shown by a broken line in FIG. 4) which forms part of the recirculation path 36 for conveying fluid from the booster outlet 32 to the booster inlet 30. The recirculation channel is located in the outer casing portion of the stator assembly to the side of, preferably co-planar with, the booster chamber. This arrangement allows the recirculation channel to be formed without significantly extending the overall dimensions of the pump particularly in the axial direction.

In this example, each transfer channel 64 and the recirculation channel 66 comprises two portions located on opposite sides of the housing, and thus on opposite sides of its respective pumping chamber. Each channel extends generally orthogonally to the axis of the drive shaft 26 or the axes of the drive shafts, between the opposing external surfaces 82, 84 of the stator components 52, 54.

Fluid pumped by pump 50 is pumped through booster inlet port 30 to the booster outlet port 32. Dependent on the pressure difference between the inlet port 30 and outlet port 32, fluid may be recirculated along recirculation path 36 (including recirculation channel 66) from the booster outlet port 32 to the booster inlet pump 30. Fluid which is not recirculated is conveyed to the inlet port 60 of the adjacent downstream compression stage for pumping and exhausted to the respective outlet port 62. Fluid exhausted from an outlet port is conveyed through transfer channels 64 to the next downstream compression stage. This process is repeated until fluid is exhausted from the pump after being pumped by the most downstream compression stage.

As seen in the example of FIG. 5, an upper plate 86 is arranged to direct fluid conveyed through the recirculation channels 66 and the transfer channels 64 to the respective inlet port 30, 60. A lower plate (not shown) is arranged to direct fluid exhausted from an outlet port 32, 62 to the respective recirculation channel 66 or transfer channel 64.

The plates may be provided with external cooling fins 86 or an additional cooling blanket (not shown) for cooling fluid passing through the pump. The cooling arrangement allows increased cooling to occur which may be beneficial given that the pump comprises a booster stage which typically generates relatively large amounts of heat.

Modifications to the above described embodiments are possible whilst still falling within the scope of the claims. For example, the stator assembly shown in FIG. 5 comprises two half shell stator components in a so-called clam shell arrangement. In one alternative, the stator assembly may be arranged as a stack of a plurality of stator slices.

The invention claimed is:

1. A multi-stage vacuum pump comprising:

a plurality of compression stages;

a booster stage, wherein the plurality of compression stages and the booster stage comprise respective rotors supported for rotation on one or more common drive shafts; and a recirculation valve associated with the booster stage configured to cause selective recirculation of pumped fluid from an outlet of the booster stage to an inlet of the booster stage above a predetermined pressure.

2. The multi-stage vacuum pump of claim 1, wherein the predetermined pressure is an absolute pressure associated with the booster stage.

3. The multi-stage vacuum pump of claim 1, wherein selective recirculation of pumped fluid is dependent on a pressure difference between the booster inlet and the booster outlet, the recirculation valve having a first condition above a predetermined pressure difference in which fluid is recirculated and a second condition below the predetermined pressure difference in which fluid recirculation is resisted by the valve.

4. The multi-stage vacuum pump of claim 3, wherein the recirculation valve comprises a valve seat and a valve member biased into engagement with the valve seat, wherein a biasing force exerted on the valve member is selected such that the force of fluid on the valve member is greater than the biasing force above the predetermined pressure difference and less than the biasing force below the predetermined pressure.

5. The multi-stage vacuum pump of claim 4, wherein the valve member comprises a ball having a weight selected such that the force of fluid on the valve at the predetermined pressure difference is generally balanced with the weight of the ball.

6. The multi-stage vacuum pump of claim 4, wherein the recirculation valve comprises a spring and a biasing force of the spring causes the valve member to engage the valve seat below the predetermined pressure difference and disengage from the valve seat above the predetermined pressure difference.

7. The multi-stage vacuum pump of claim 1, further comprising a recirculation path extending from the booster outlet to the booster inlet and the recirculation valve is located along the recirculation path.

8. The multi-stage vacuum pump of claim 7, further comprising a stator assembly comprising an outer casing portion that forms respective pumping chambers of the plurality of compression stages and the booster stage, and inter-stage walls for forming partitions between the respective pumping chambers, wherein the recirculation path is formed at least partially by a recirculation channel which extends through the outer casing portion.

9. The multi-stage vacuum pump of claim 1, further comprising a stator assembly comprising:

an outer casing portion that forms respective pumping chambers of the plurality of compression stages and the booster stage;

inter-stage walls for forming partitions between the respective pumping chambers; and a plurality of transfer channels formed in the outer casing portion for conveying fluid from an outlet of a compression stage of the plurality of compression stages to an inlet of an adjacent compression stage of the plurality of compression stages.

10. The multi-stage vacuum pump of claim 8, wherein the recirculation channel extends generally orthogonally to an axis of the multi-stage vacuum pump on at least one side of the respective pumping chambers.

11. The multi-stage vacuum pump of claim 1, wherein a ratio of volumetric capacity between adjacent compression stages of the plurality of compression stages is less than 2:1.

12. A stator for a multi-stage pump, wherein the stator comprises:

an outer casing portion that forms respective pumping chambers of a plurality of compression stages and a booster stage and defines a booster inlet, a booster outlet, and a recirculation channel that extends through the outer casing portion between the booster outlet and the booster inlet; and inter-stage walls for forming partitions between the respective pumping chamber.

13. The multi-stage vacuum pump as claimed in of claim 9, wherein the plurality of transfer channels extend generally orthogonally to an axis of the multi-stage vacuum pump on at least one side of the respective pumping chambers.

14. The stator of claim 12, wherein the outer casing portion further defines a plurality of transfer channels for conveying fluid from an outlet of a compression stage of the plurality of compression stages to an inlet of an adjacent compression stage of the plurality of compression stages.

15. The stator of claim 12, wherein the recirculation channel extends generally orthogonally to an axis of the stator on at least one side of the respective pumping chambers.

16. The stator of claim 14, wherein the plurality of transfer channels extend generally orthogonally to an axis of the stator on at least one side of the respective pumping chambers.

17. The multi-stage vacuum pump of claim 1, wherein a ratio of volumetric capacity between the booster stage and an adjacent downstream compression stage of the plurality of compression stages is between 5:1 and 20:1.

18. The stator of claim 12, wherein a ratio of volumetric capacity between the booster stage and an adjacent downstream compression stage of the plurality of compression stages is between 5:1 and 20:1.

* * * * *